US008123637B1

(12) United States Patent
Demko et al.

(10) Patent No.: US 8,123,637 B1
(45) Date of Patent: Feb. 28, 2012

(54) STUN PROJECTILE FOR A BLOW GUN

(75) Inventors: Andrew Demko, Wampum, PA (US); Michael T. Wallace, New Castle, PA (US)

(73) Assignee: Cold Steel, Ventura, CA (US)

( * ) Notice: Subject to any disclaimer, the term of this patent is extended or adjusted under 35 U.S.C. 154(b) by 147 days.

(21) Appl. No.: 12/660,114

(22) Filed: Feb. 22, 2010

(51) Int. Cl.
*F42B 6/00* (2006.01)

(52) U.S. Cl. ..... 473/578; 124/62

(58) Field of Classification Search ..... 124/62; 473/578, 582, 585, 586
See application file for complete search history.

(56) References Cited

U.S. PATENT DOCUMENTS

| | | | | | |
|---|---|---|---|---|---|
| 3,251,353 | A | * | 5/1966 | Battaglia | 124/65 |
| 3,388,696 | A | * | 6/1968 | Hoverath et al. | 124/62 |
| 3,457,921 | A | | 7/1969 | Waldeisen | |
| 3,735,748 | A | | 5/1973 | Gaylord | |
| 3,746,334 | A | * | 7/1973 | Stubblefield | 482/20 |
| 4,283,061 | A | | 8/1981 | Jordan | |
| 4,419,978 | A | | 12/1983 | Loftus | |
| 4,537,176 | A | * | 8/1985 | Stravitz et al. | 124/62 |
| 5,590,885 | A | * | 1/1997 | Graham et al. | 273/348.5 |
| 5,718,214 | A | * | 2/1998 | Altman et al. | 124/62 |

* cited by examiner

*Primary Examiner* — John Ricci
(74) *Attorney, Agent, or Firm* — Harpman & Harpman

(57) ABSTRACT

A stun dart having a solid impact head with a conical shaped tail portion interconnected by a solid cylindrical elongated body. The impact head has a contoured front surface with intersecting grooves and a tapered trailing body surface to impart flight stability and maximum travel distance and impact delivery to the target.

8 Claims, 2 Drawing Sheets

STUN PROJECTILE FOR A BLOW GUN

BACKGROUND OF THE INVENTION

1. Technical Field

This invention is directed to blow gun darts that are used for sport hunting. Such darts are launched from the blow gun by the force of air provided by the user.

2. Description of Prior Art

Prior art blow gun darts have been developed based on user requirements and sealing properties within the blow gun wherein an air pressure build-up is needed to propel the dart down the barrel of the blow gun and to traverse a substantially straight path to the target, see U.S. Pat. Nos. 3,457,921, 3,735,748 and 4,419,978.

In U.S. Pat. No. 3,457,921, an immobilizer dart can be seen having shaped tip end with a rubber cylinder on a wire support shaft. A notch is provided within the end for an immobilizer drug to be inserted.

U.S. Pat. No. 3,735,748 claims a combined blow gun and dart illustrating a blow gun dart having a shaft with a point on which is secured a dart body defined by the air seal within the blow gun.

U.S. Pat. No. 4,283,061 discloses a blow gun dart having a tapered shaft with a rearwardly positioned hollow impeller. A conical end tip is formed by the tapered shaft defining an angle of thirty degrees with respect to the center line of the shaft.

Finally, in U.S. Pat. No. 4,419,978 illustrates a breath operated dart device shown as a typical dart with a wire shaft pointed end and a bulbous end member at the rear to seal same for propelling the dart.

Prior art includes well known darts used by indigenous native tribes and are typically defined by a sharpened shaft of natural material and a winding on the end of natural fibers sufficient to form a seal within the blow gun. Such darts may be dipped in naturally occurring poison to aid in hunting birds and small animals in their natural environments.

SUMMARY OF THE INVENTION

A stun projectile dart for blow guns that provides for a non-lethal projectile used in hunting. The dart's configuration permits blowing of the dart out of the blow gun formed of a long hollow tube at a high velocity and maintaining a straight flight path. The stun dart has a contoured mass inducing weighted front impact end with a barrel sealing propellant enabling fusto conical hollow flight on the end of said body with an interconnecting support shaft therebetween. The stun dart head configuration therefore imparts the aerodynamic flight direction path for accurate range transition to the extended target.

DETAILED DESCRIPTION OF THE INVENTION

Figure 1:
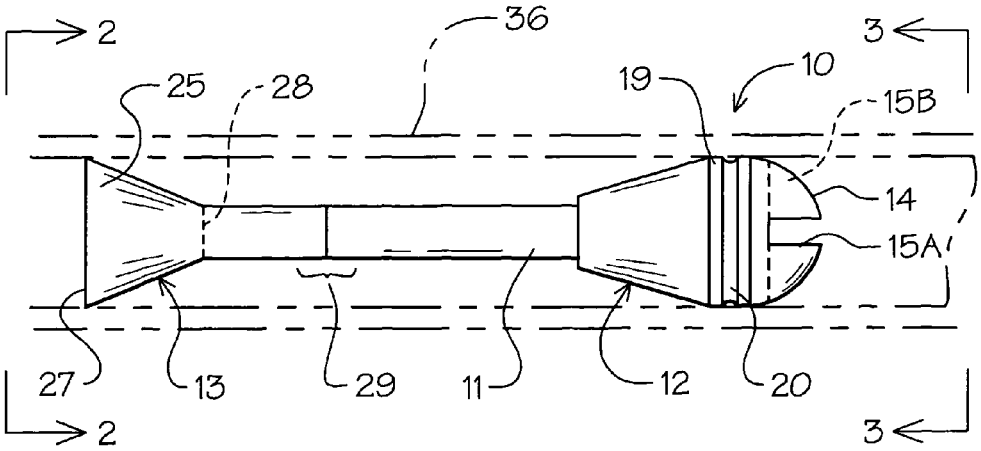
FIG. 1 is a side elevational view of the stun dart of the invention within a blow gun shown in broken lines.
Figure 2:
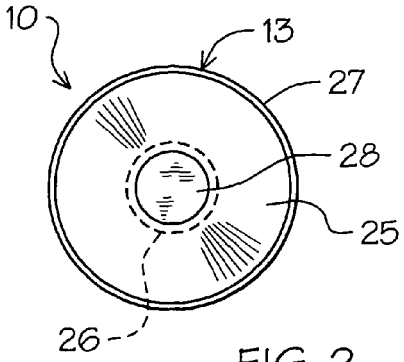
FIG. 2 is an end view thereon on lines 2-2 of FIG. 1.
Figure 3:
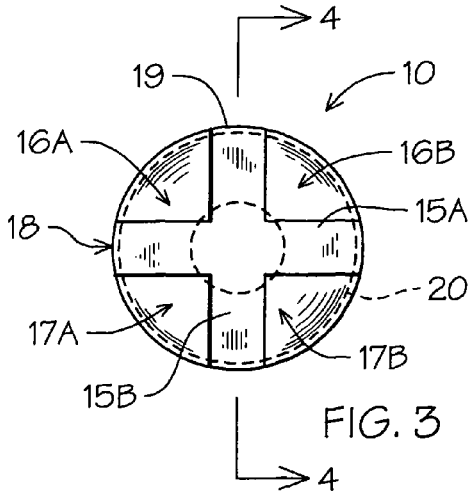
FIG. 3 is an oppositely disposed end view thereof on line 3-3 of FIG. 1.

Referring now to FIGS. 1, 2 and 3 of the drawings, a stun dart 10 of the invention can be seen having a monolithic center body support shaft 11 with an enlarged head end 12 and a trailing propellant end 13. The engagement head end 12 has an enlarged contoured striking surface 14 with intersecting right angularly axially aligning channels 15A and 15B formed therein. The cross channels 15A and 15B define multiple opposing surface impact sections 16A and 16B and 17A and 17B, best seen in FIG. 3 of the drawings. The surface impart sections 16A, 16B, 17A and 17B are therefore contoured defining segmented cone surface 18 extending to a mid position annular transition surface band 19. The respective depth of the channels 15A and 15B are equal and terminate in spaced relation to the so-defined annular transition surface band 19, best seen in FIG. 1 of the drawings.

An annular groove 20 is centrally formed within the surface band 19 dividing it circumferentially for airflow in-flight induced characteristics as will be discussed in greater detail hereinafter.

The engagement head end surface 12 is tapered rearwardly at 21 from the annular transition surface band 19 to engagement of the central support shaft 11 which is secured thereto by registering engagement within a mounting and received placement bore 22 axially aligned therewithin.

Figure 4:
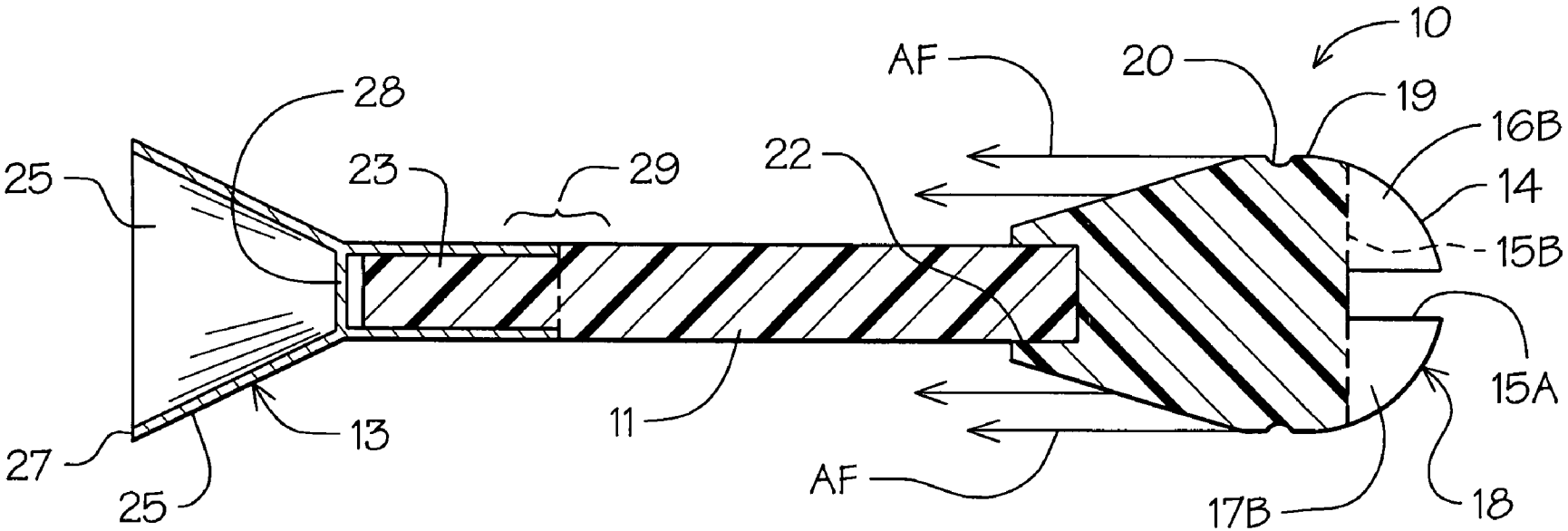
FIG. 4 is an enlarged cross-sectional view on lines 4-4 of FIG. 3.

The center support shaft 11 is solid and has an area of reduced annular dimension at 23 extending inwardly from its oppositely disposed end 24 as best seen in FIG. 4 of the drawings. The trailing propellant end 13 of the stun dart 10 has a hollow fusto conical portion 25 and an integrally extending shaft receiving tubular portion 26 extending centrally therefrom. The fusto conical portion 25 has a continuous annularly disposed sidewall 25A defining an open end edge 27 tapering to a base end 28 from which the tubular portion 26 so extends.

The shaft receiving tubular portion 26 extends centrally from the base end 28 and is of an open interior dimension for a press fit registration on the hereinbefore described support shaft area of reduced annular dimension at 23. It will therefore be seen that the outer surface dimension of the solid support shaft 11 is equal to that of the shaft receiving tubular portion 26 indicating by a co-planar transition area generally indicated annularly at 29 as seen in FIG. 4 of the drawings.

The intrinsic mass of the engagement head portion 12 coupled with the aerodynamic surface configuration thereof imparts during flight a stable trajectory maintaining directional accuracy and transition to target illustrated generally by airflow surface impingement flow arrows AF.

The hollow fusto conical trailing projectile end 13 open end edge 27 is of the same diameter as that of the head portion 12 defines a seal within the blow gun 36, shown in broken lines in FIG. 1 of the drawings. The projectile end 13 allows for user induced air pressure indicated by arrow P to propel the dart 10 through and out of the blow gun.

It will thus be seen that a new and novel blow gun dart in the form of a stun dart 10 of the invention has been illustrated and described and it will be apparent to those skilled in the art that various changes and modifications may be made thereto without departing from the spirit of the invention.

Therefore we claim:

1. A blow gun dart comprising, an elongated center support shaft, an enlarged forward engagement head on the end of said shaft, a hollow conical projection on the free end of said shaft in spaced relation to said engagement head, cross channels in said engagement head in center aligned axis thereto, said engagement head inducing a tapered surface to said elongated center support shaft wherein the center of gravity of said dart is located within said engagement head.

2. The blow gun dart according to claim 1 wherein said enlarged forward engagement head has an annular transition band thereabout with a groove in said band.

3. The blow gun dart according to claim 1 wherein said center support shaft has an area of reduced annular dimension registerable within said conical projection.

4. The blow gun dart according to claim 1 wherein said hollow conical projection comprises, a conical portion and cylindrical mounting portion extending therefrom.

5. The blow gun dart according to claim 1 wherein said cross channels are at right angles to one another.

6. The blow gun dart according to claim 1 wherein said engagement head and said conical portion are of an equal diameter and are continuous with one another.

7. The blow gun dart according to claim 1 wherein said cross channels in said engagement head are of an equal depth.

8. The blow gun dart according to claim 1 wherein said cross channels in said engagement head are at right angles to one another.

* * * * *